US009501001B2

(12) United States Patent
Bennett et al.

(10) Patent No.: US 9,501,001 B2
(45) Date of Patent: Nov. 22, 2016

(54) TRANSFER DEVICE AND SYSTEM FOR AN ELECTROPHOTOGRAPHIC DEVICE COMPRISING MULTIPLE ELECTRODES

(71) Applicant: Lexmark International, Inc., Lexington, KY (US)

(72) Inventors: Christopher Michael Bennett, Paris, KY (US); Gerald Floyd Davis, Lexington, KY (US); Kurt Daniel Lambert, Lexington, KY (US); Niko Jay Murrell, Lexington, KY (US); Julie Ann Gordon Whitney, Georgetown, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 14/806,390

(22) Filed: Jul. 22, 2015

(65) Prior Publication Data

US 2015/0331367 A1 Nov. 19, 2015

Related U.S. Application Data

(63) Continuation-in-part of application No. 14/066,847, filed on Oct. 30, 2013, now abandoned.

(51) Int. Cl.
*G03G 15/16* (2006.01)

(52) U.S. Cl.
CPC ..... *G03G 15/1665* (2013.01); *G03G 15/1605* (2013.01); *G03G 2215/0132* (2013.01); *G03G 2215/1633* (2013.01)

(58) Field of Classification Search
CPC ..... G03G 15/1645; G03G 15/1635; G03G 15/1665; G03G 15/1605; G03G 2215/132; G03G 2215/1633
USPC ..... 399/310
See application file for complete search history.

(56) References Cited

U.S. PATENT DOCUMENTS

| | | | | |
|---|---|---|---|---|
| 3,936,174 | A | 2/1976 | Carpenter | |
| 4,410,896 | A | 10/1983 | Nelson et al. | |
| 4,571,052 | A | 2/1986 | Shirai | |
| 4,922,299 | A | 5/1990 | Uchimoto et al. | |
| 5,081,501 | A | 1/1992 | Waki et al. | |
| 5,198,863 | A | 3/1993 | Goto et al. | |
| 5,701,567 | A * | 12/1997 | Bucks | G03G 15/162 399/302 |
| 5,889,544 | A | 3/1999 | Mey et al. | |
| 6,134,415 | A | 10/2000 | Iwakura et al. | |
| 6,268,051 | B1 | 7/2001 | Tsunemi et al. | |
| 7,274,902 | B2 | 9/2007 | Holstun et al. | |
| 7,610,003 | B2 | 10/2009 | Watanabe et al. | |

(Continued)

OTHER PUBLICATIONS

Clayton, R.P. et al., Introduction to Electromagnetic Fields. McGrawHill, 1998, Chapter 3.*

*Primary Examiner* — Billy Lactaoen
*Assistant Examiner* — Arlene Heredia Ocasio

(57) ABSTRACT

A device for transferring images from an image donating member to an image receiving medium comprises a substrate, at least two electrodes disposed on the substrate, and at least one layer of coating disposed on the substrate having an outer surface for forming a nip region with the image donating member. The at least two electrodes are controllable to produce an electric field and control a position thereof at the nip region to allow transfer of an image from the image donating member to the image receiving medium in an image transfer operation.

21 Claims, 8 Drawing Sheets

(56) References Cited

U.S. PATENT DOCUMENTS

2004/0156658 A1 8/2004 Aoki et al.
2009/0116882 A1 5/2009 Rimai et al.
2009/0160920 A1* 6/2009 Badesha ..... B41J 2/01 347/88
2009/0324306 A1 12/2009 Echigo et al.
2012/0201576 A1* 8/2012 Uno ..... G03G 15/0813 399/281
2012/0308272 A1 12/2012 Nakaegawa
2014/0199089 A1 7/2014 Ishikawa

* cited by examiner

TRANSFER DEVICE AND SYSTEM FOR AN ELECTROPHOTOGRAPHIC DEVICE COMPRISING MULTIPLE ELECTRODES

CROSS REFERENCES TO RELATED APPLICATIONS

Pursuant to 37 C.F.R. 1.78, this application is a continuation-in-part application and claims the benefit of the earlier filing date of application Ser. No. 14/066,847, filed Oct. 30, 2013, entitled, "Transfer System for an Electrophotographic Device," the content of which is hereby incorporated by reference herein in its entirety.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to an image forming apparatus and, more particularly, to systems and devices for transferring toner in an electrophotographic imaging system.

2. Description of the Related Art

Transfer process, whereby toner is moved from a donating medium to an accepting medium, is a core process in an electrophotographic printing process. The process starts when a photosensitive member, such as a photoconductor, is charged and then selectively discharged to create a charge image. The charge image is developed by a developer roll covered with charged toner of uniform thickness. This developed image then travels to what is referred to as "first transfer" in the case of a two-step transfer system, or the only transfer process in the case of direct-to-paper systems.

Transfer robustness is frequently measured as the amount of voltage between the lowest voltage at which acceptable transfer occurs due to a sufficient electric field having been established to move toner, and the highest voltage at which acceptable printing occurs before Paschen breakdown, i.e., the voltage at which the dielectric properties of the materials in the transfer nip begin to break down, causes undesirable print artifacts. The larger the difference between the lowest and highest voltages, the more tolerance exists for part-to-part variation while still yielding relatively good quality prints. The lower end of the transfer operating window is typically determined by how well the electric field, measured in volts/meter, can be established, and by how much electric field is then required to overcome the forces of adhesion between the toner and the donating medium (photoconductor or belt). The upper end of the transfer operating window is the point at which the electric field established to transfer the toner exceeds the breakdown strength of an air gap or dielectric layer, allowing a discharge event to occur.

In traditional first transfer systems, the developed toner enters a transfer station or nip area between a photoconductor roll and a transfer roll. The media to which the developed toner image is to be transferred, either an intermediate transfer member (ITM) for a two-step transfer system or a transport belt supporting paper for a direct-to-paper system, is positioned between these two rolls. Time, pressure and electric fields all influence the quality of the transfer process. A voltage is applied to the transfer roll to create a field to pull charged toner off the photoconductor roll onto the desired medium.

Relatedly, in traditional two-step transfer systems, the ITM, now carrying the charged toner, travels to a second transfer station or nip area, similar in some ways to the first transfer nip. The toner is again brought into contact with the toner receiving medium in the second transfer nip formed by a number of rolls. Typically a conductive backup roll and a resistive transfer roll together form the two primary sides of the second transfer nip. As with the first transfer, time, pressure and applied fields play significant roles in ensuring high efficiency transfer.

The above traditional roller-based transfer configurations have served transfer systems well. However, roller hardware has several deficiencies that have become more evident as process speeds are increased and support for a broader set of operating environments is extended. To illustrate these deficiencies, FIGS. 1-2 are depicted which are based on outputs from finite element models. It should be noted that the example configurations of FIGS. 1-2 are illustrated for demonstration purposes only.

FIG. 1A illustrates an example of a roller-based transfer configuration having a transfer roller 10A with a 0 mm offset arrangement relative to a photoconductive drum 15A (or a nip 20A formed by the photoconductive drum 15 A and an ITM 25A), FIG. 1B illustrates an example of another roller transfer configuration having a transfer roller 10B with a 1.5 mm offset arrangement downstream from a photoconductive drum 15B (or a nip 20B formed between the photoconductive drum 15B and an ITM 25B), while FIG. 2 is a diagram illustrating graphs 17A, 17B of electric field magnitudes in the air gaps at the nip regions as a function of roller placement relative to nip 20 (at 0 mm) for each of the roller configurations of FIGS. 1A and 1B, respectively. FIG. 2 further shows a curve 18 corresponding to the air gap between the ITM 25 and photoconductive drum 15. In these examples, process direction is from left to right such that photoconductive drums 15 and transfer rollers 10 rotate counter-clockwise and clockwise, respectively.

For the configuration shown in FIG. 1A, when a corresponding bias voltage is applied to transfer roller 10A, relatively high electric field values may develop on the underside of ITM 25A post nip (illustrated in FIG. 2, peak electric field 30A of graph 17A occurring on the underside of ITM 25A is located after 0 mm nip position), due in part to displacement currents created by capacitive coupling effects between transfer roller 10A and ITM 25A. These displacement currents are created as the separation distance between the surface and the transfer roller surface changes. In particular, as the transfer roller surface approaches the nip 20A, voltage differential decreases with separation distance and reduces the electric field, and as the transfer roller surface exits the nip, voltage differential increases and intensifies electric field post nip. This effect will also be dependent upon how quickly the air gaps open and close (i.e., depending on process speed and roller geometry) and how quickly the roller may respond to the changing electric field (i.e., depending on transfer roller resistivity or moisture content). This peak electric field 30A (FIG. 2) located post nip and on the underside of ITM 25A may cause a "first transfer over transfer" failure which results from breakdown in the air gap between the transfer roller 10A and ITM 25A prior to the point at which an electric field sufficient to transfer toner from the photoconductive drum 15A to ITM 10A is built. This type of failure causes discharge events which may disrupt the electric field between the photoconductive drum and ITM 25A, and may lead to additional breakdown events or disturb the toner on ITM 25A, resulting in poor transfer.

For the configuration shown in FIG. 1B, when a corresponding bias voltage is applied to the transfer roller 10B, a peak electric field 30B (FIG. 2) may develop on the top side of ITM 25B a greater distance from the 0 mm nip position due at least in part to the diffuse nature of the roller and capacitive coupling effects. The consequence of this peak field location post nip is a "negative ghosting" failure which results from breakdown in the air gap between ITM 25A and photoconductive drum 15B. This breakdown event deposits charges on the surface of the photoconductive drum and causes additional toner to be deposited on the photoconductive drum surface during subsequent development steps, resulting in locally darker print in future images.

In both example cases, the electric fields are asymmetrically skewed post nip because of capacitive coupling effects, thereby making it difficult to predict the peak field location as process speed changes. Additionally, the peak field 30B location for the 1.5 mm offset roller of FIG. 1B is positioned further downstream from the nip 20 relative to the peak field 30A for the 0 mm arrangement of FIG. 1A, further demonstrating the sensitivity of the roller system to mechanical tolerances. Thus, part variation may drastically impact where the peak electrical field is established. Due to the diffuse nature of a roller system, high strength electric fields are also developed wherever large voltage differential exists across an air gap, such as at distances far removed from the nip 20 across air gaps in non-functional regions surrounding the nip 20 and on the underside of the ITM 25. For example, in FIG. 2, field values greater than $1\times10^7$ V/m are sustained for a distance of approximately 1 mm around the nip 20A for the configuration shown in FIG. 1A, and for a distance of approximately 2.5 mm from the nip 20B for the configuration shown in FIG. 1B. Sustaining high strength fields for longer than is necessary may provide the system with a greater opportunity to discharge in an unintended fashion.

Thus, the field shape generated by a roller in a roller-based transfer system is diffused which generally makes it difficult to accurately place the peak field location relative to the nip. Additionally, high strength electric fields are developed across air gaps in non-functional regions surrounding the nip and on the underside of the belt. Furthermore, electric fields are also distorted by capacitive coupling effects and displacement currents may contribute to discharge events post nip which may further limit the upper end of the transfer window.

Based upon the foregoing, there is a need for an improved transfer system in an electrophotographic imaging device.

SUMMARY

Embodiments of the present disclosure provide an electrode-based transfer configuration which overcome or at least mitigate the deficiencies of roller-based transfer configurations described above. An example embodiment is a device for transferring images from an image donating member to an image receiving medium, including: a substrate; at least three electrodes disposed on the substrate, including a center electrode and at least two guard electrodes disposed at opposed sides of the center electrode; and at least one coating layer disposed on the at least three electrodes and having an outer surface for forming a nip region with the image donating member. The center electrode and the at least two guard electrodes are controllable to produce an electric field and control a position thereof at the nip region to allow transfer of an image from the image donating member to the image receiving medium in an image transfer operation. The at least two guard electrodes include a first guard electrode and a second guard electrode, and wherein a distance between the first guard electrode and the center electrode is greater than a distance between the center electrode and the second guard electrode. In an example embodiment, the device includes a third guard electrode disposed between the first guard electrode and the center electrode. In another example embodiment, the outer surface of the device is non-planar.

In another example embodiment, a toner transfer system includes a donating member for donating toner; a transfer member including a substrate, at least three electrodes disposed on the substrate, and a coating formed on the at least three electrodes, the transfer member serving to form a nip region with the donating member; and voltage supply circuitry coupled to the transfer member for supplying bias voltages to the at least three electrodes so as to produce an electric field and control a position thereof at the nip region to allow the electric field to act upon and cause toner to transfer from the donating member to a toner receiving medium disposed between the donating member and the transfer member in the nip region during a toner transfer operation. The at least three electrodes include a center electrode and at least two guard electrodes disposed at opposed sides of the center electrode. The center electrode generates and controls a magnitude of the electric field, and the guard electrodes control the shape of the electric field at the nip region. In addition, the slope of the electric field on an output side of the nip region has a magnitude that is at two times greater than the magnitude of the slope of the electric field on an input side of the nip region. In an example embodiment, the voltage supply circuitry is a low voltage power supply.

BRIEF DESCRIPTION OF THE DRAWINGS

The above-mentioned and other features and advantages of the disclosed example embodiments, and the manner of attaining them, will become more apparent and will be better understood by reference to the following description of the disclosed example embodiments in conjunction with the accompanying drawings, wherein.

DETAILED DESCRIPTION

Figure 1A:
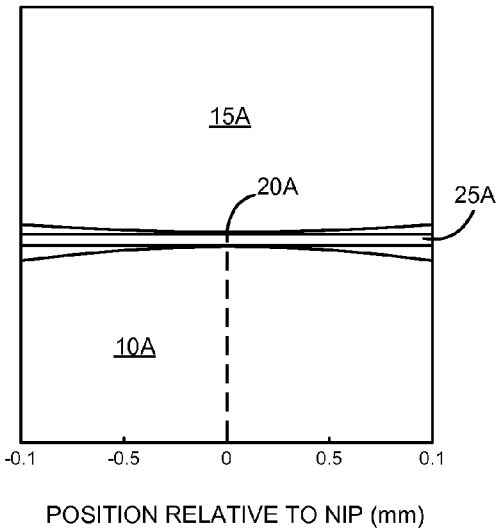
FIG. 1A (PRIOR ART)
FIG. 1A is a diagram illustrating an example model of a traditional roller-based transfer configuration.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Spatially relative terms such as "top", "bottom", "front", "back" and "side", and the like, are used for ease of description to explain the positioning of one element relative to a second element. Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the exemplary embodiment(s) of the invention, as illustrated in the accompanying drawings. Whenever possible, the same reference numerals will be used throughout the drawings to refer to the same or like parts.

Figure 3:
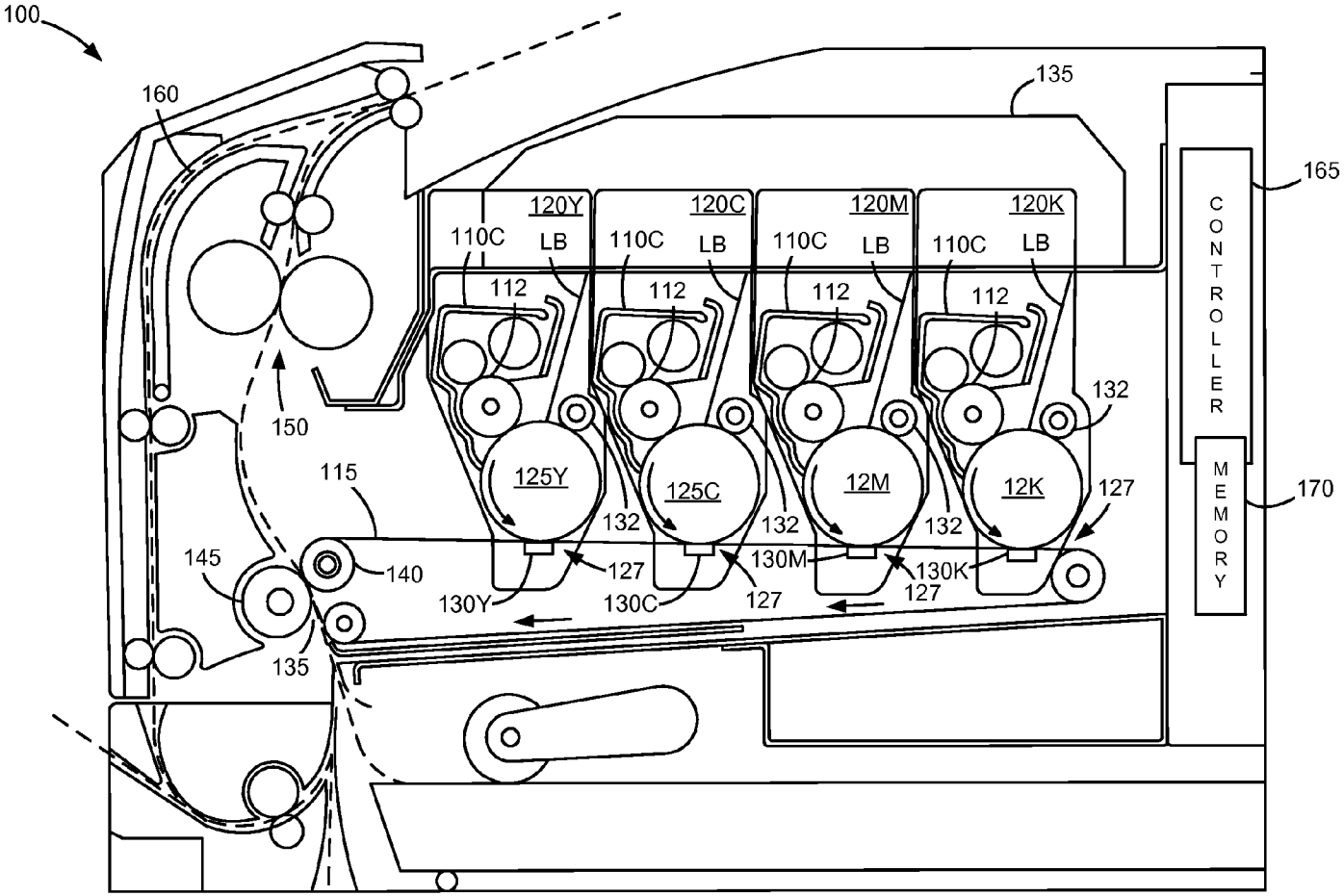
FIG. 3 is a side view of an electrophotographic imaging system according to an example embodiment of the present disclosure.

FIG. 3 illustrates a color image forming device 100 according to an example embodiment. Image forming device 100 includes a first toner transfer area 105 having four developer units 110, including developer rolls 112, that substantially extend from one end of image forming device 100 to an opposed end thereof. Developer units 110 are disposed along an intermediate transfer member (ITM) 115. Each developer unit 110 holds a different color toner. The developer units 110 may be aligned in order relative to the direction of the ITM 115 indicated by the arrows in FIG. 3, with the yellow developer unit 110Y being the most upstream, followed by cyan developer unit 110C, magenta developer unit 110M, and black developer unit 110K being the most downstream along ITM 115.

Each developer unit 110 is operably connected to a toner reservoir 120 for receiving toner for use in a printing operation. Each toner reservoir 120 is controlled to supply toner as needed to its corresponding developer unit 110. Each developer unit 110 is associated with a photoconductive member 125 that receives toner therefrom during toner development to form a toned image thereon. Each photoconductive member 125 is paired with a transfer member 130 to define a transfer station 127 for use in transferring toner to ITM 115 at first transfer area 105.

During color image formation, the surface of each photoconductive member 125 is charged to a specified voltage by a charge roller 132. At least one laser beam LB from a printhead or laser scanning unit (LSU) 135 is directed to the surface of each photoconductive member 125 and discharges those areas it contacts to form a latent image thereon. In one embodiment, areas on the photoconductive member 125 illuminated by the laser beam LB are discharged. The developer unit 110 then transfers toner to photoconductive member 125 to form a toner image thereon. The toner is attracted to the areas of the surface of photoconductive member 125 that are discharged by the laser beam LB from LSU 135.

ITM 115 is disposed adjacent to each of developer unit 110. In this embodiment, ITM 115 is formed as an endless ITM disposed about a drive roller and other rollers. During image forming operations, ITM 115 moves past photoconductive members 125 in a clockwise direction as viewed in FIG. 3. One or more of photoconductive members 125 applies its toner image in its respective color to ITM 115. For mono-color images, a toner image is applied from a single photoconductive member 125K. For multi-color images, toner images are applied from two or more photoconductive members 125. In one embodiment, a positive voltage field formed in part by transfer member 130 attracts the toner image from the associated photoconductive member 125 to the surface of moving ITM 115.

ITM 115 rotates and collects the one or more toner images from the one or more photoconductive members 125 and then conveys the one or more toner images to a media sheet at a second transfer area 135. Second transfer area 135 includes a second transfer nip formed between a back-up roller 140 and a second transfer member 145.

Fuser assembly 150 is disposed downstream of second transfer area 135 and receives media sheets with the unfused toner images superposed thereon. In general terms, fuser assembly 150 applies heat and pressure to the media sheets in order to fuse toner thereto. After leaving fuser assembly 150, a media sheet is either deposited into output media area 155 or enters duplex media path 160 for transport to second transfer area 135 for imaging on a second surface of the media sheet.

Image forming device 100 is depicted in FIG. 3 as a color laser printer in which toner is transferred to a media sheet in a two-step operation. Alternatively, image forming device 100 may be a color laser printer in which toner is transferred to a media sheet in a single step process—from photoconductive members 125 directly to a media sheet. In another alternative embodiment, image forming device 100 may be a monochrome laser printer which utilizes only a single developer unit 110 and photoconductive member 125 for depositing black toner directly to media sheets. Further, image forming device 100 may be part of a multi-function product having, among other things, an image scanner for scanning printed sheets.

Image forming device 100 further includes a controller 165 and an associated memory 170. Though not shown in FIG. 3, controller 165 may be coupled to components and modules in image forming device 100 for controlling same. For instance, controller 165 may be coupled to toner reservoirs 120, developer units 110, photoconductive members 125, fuser assembly 150 and/or LSU 135 as well as to motors (not shown) for imparting motion thereto. It is understood that controller 165 may be implemented as any number of controllers and/or processors for suitably controlling image forming device 100 to perform, among other functions, printing operations.

Figure 4:
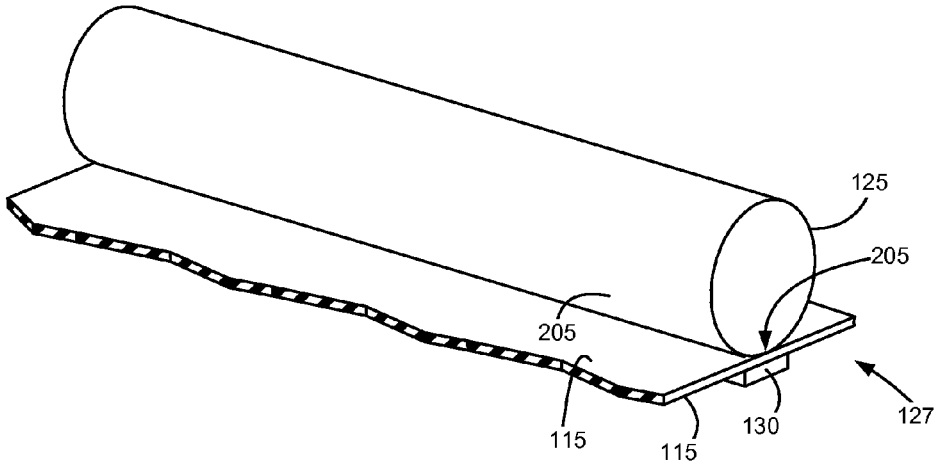
FIG. 4 illustrates transfer configuration at a transfer station within the imaging system of FIG. 3 according to an example embodiment.

Referring now to FIG. 4, a transfer configuration, which can be utilized at each transfer station of first transfer area 105 to eliminate or at least mitigate the deficiencies of a roller-based transfer configuration, is illustrated in accordance with example embodiments of the present disclosure. In the example shown, photoconductive drum 125 forms nip region 205 with ITM 115 at transfer station 127. On the underside of ITM 115 is transfer member 130 that is used to produce an electric field to move toner from the surface 210 of the photoconductive drum 125 to the surface 215 of the ITM 115 in a transfer process.

Figure 5:
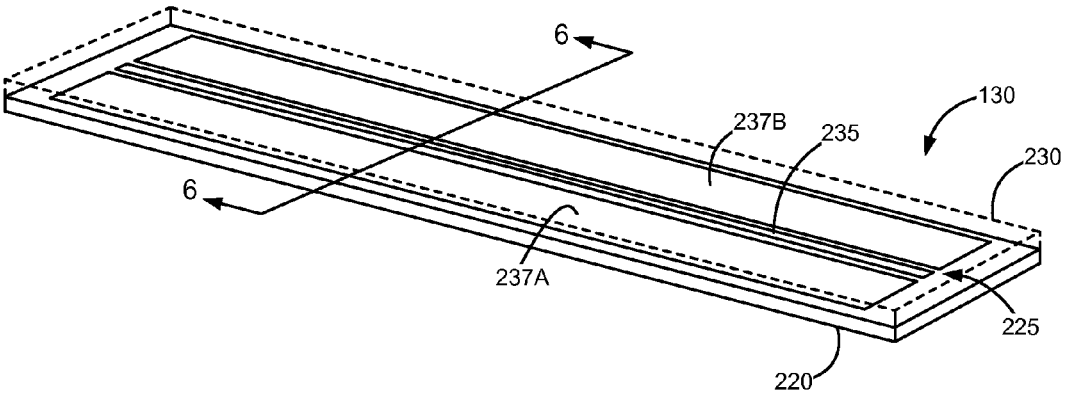
FIG. 5 illustrates an electrode-based transfer member of the transfer configuration shown in FIG. 4 according to an example embodiment.
Figure 6A:
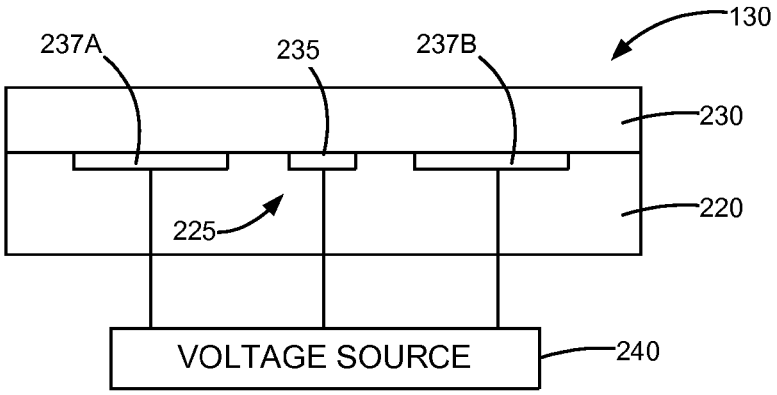
FIGS. 6A is a cross-sectional view of the transfer member taken along line 6-6 of FIG. 5, according to an example embodiment.

FIG. 5 illustrates transfer member 130 according to an example embodiment. FIG. 6A further shows a cross-sectional view of transfer member 130 taken along line 6-6 of FIG. 5. As shown, transfer member 130 includes a substrate 220, an electrode assembly 225 disposed on the substrate 220, and a coating 230 covering the electrode assembly 225 and the upper surface of the substrate 220. Generally, during a transfer process, transfer member 130 may remain substantially stationary and electrode assembly 225 may be used to build, shape, and/or position electric fields in proximity to photoconductive member 125 to cause toner transfer at transfer station 127, as will be explained in detail below.

Substrate 220 may be any electrically insulative material that can serve as the base for supporting the electrode assembly 225. Electrode assembly 225 may include a plurality of electrodes, such as a center electrode 235, and first and second guard electrodes 237A, 237B at opposed sides of center electrode 235. In an example embodiment, electrodes 235, 237 may extend across a longitudinal length of substrate 220 and extend substantially parallel relative to each other. Different techniques may be used to provide electrodes on substrate 220. For example, substrate 220 may comprise a printed circuit board (PCB) and electrodes 235, 237 may be formed as metal traces on substrate 220 by etching a metal layer using conventional methods. In other examples, substrate 220 can be any other suitable material and electrodes 235, 237 may be adhesively attached to substrate 220, or provided on substrate 220 by forming trenches on substrate 220 and introducing conductive materials, such as metals, into the trenches.

Electrodes 235, 237 are shown as solid blocks of conductors formed on the upper surface of substrate 220. In other alternative example embodiments, electrodes 235, 237 may follow other patterns. Electrodes 235, 237 may each have a width between about 0.25 mm and about 2 mm, and may be spaced apart from each other at a distance between about 0.25 mm and about 2 mm. In an example embodiment, the center electrode 235 may have a width that is different from the widths of guard electrodes 237. For example, the center electrode 235 may have a width that is narrower relative to widths of the guard electrodes 237, or vice versa. In another example embodiment shown in FIG. 6B, guard electrode 237A, corresponding to the guard electrode on the upstream or entry side of transfer nip 205 may be spaced further from the center electrode 235 than the spacing between the other guard electrode 237B and center electrode 235. Another variation of transfer member 130 is illustrated in FIG. 6C in which a third guard electrode 237C is employed and positioned between guard electrode 237A and center electrode 235 on the entry side of transfer nip 205. In this embodiment, guard electrode 237A is positioned further from center electrode 235 than the spacing between each of guard electrodes 237B and 237C from center electrode 235, with guard electrodes 237B and 237C being roughly the same distance from center electrode 235. Guard electrode 235C may be used with guard electrodes 235A and 235B to better control the shape of the electric field generated by transfer member 130, as explained in greater detail below.

Figure 6B:
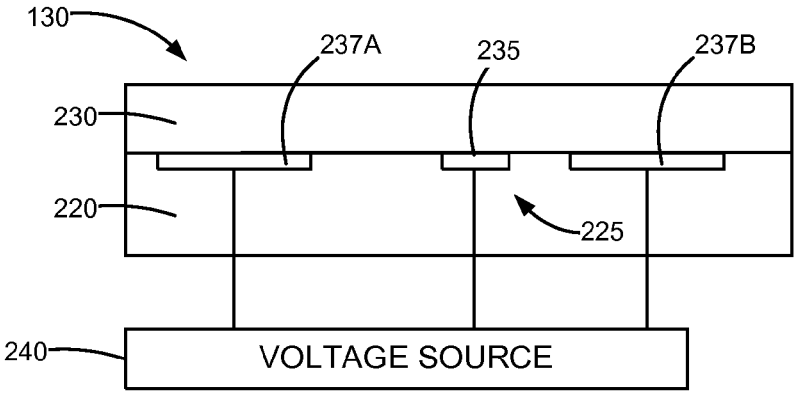
FIGS. 6B-6E are cross-sectional views of the transfer member according to additional example embodiments.
Figure 6C:
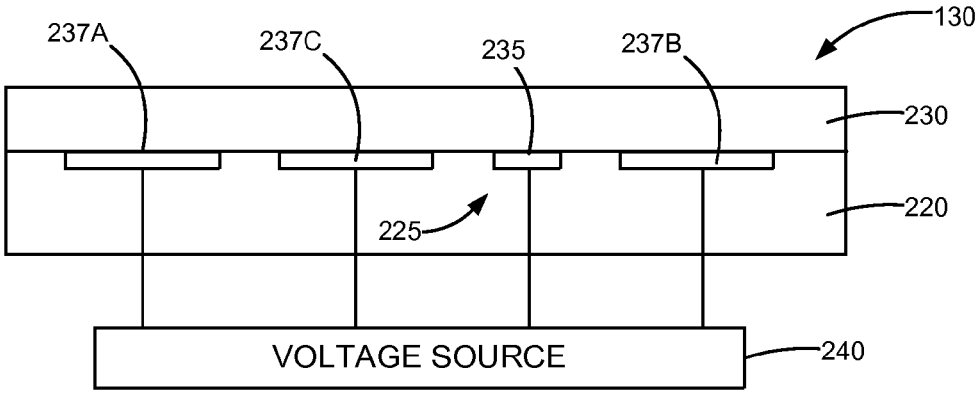
Figure 6D:
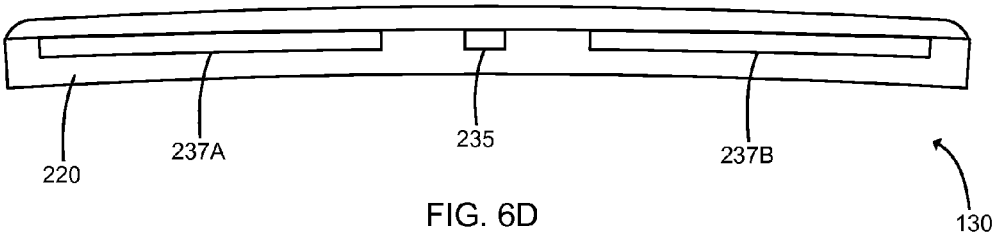
Figure 11:
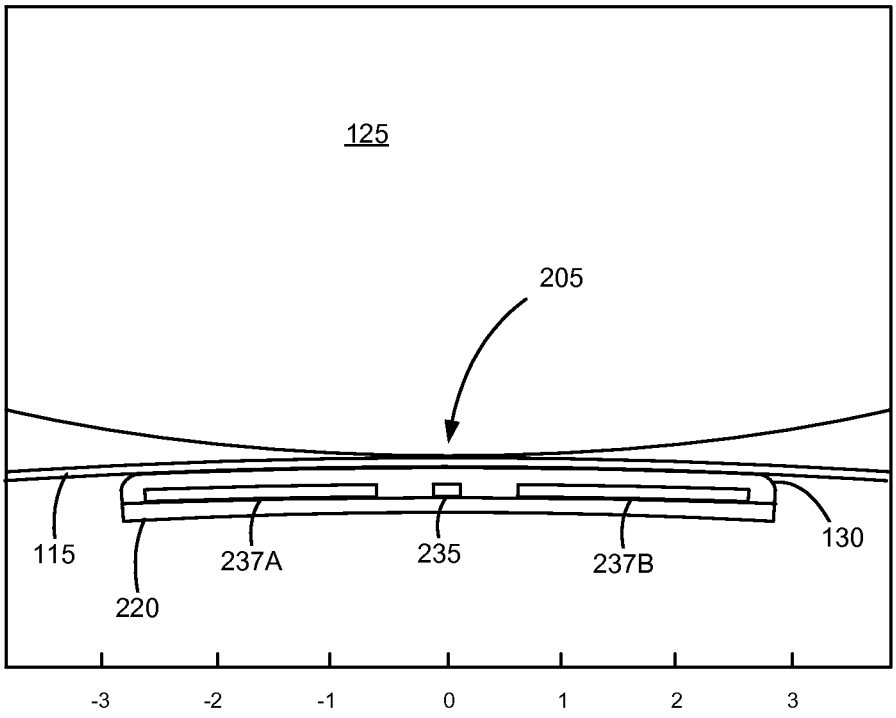
FIG. 11 is a diagram illustrating a transfer region formed between a photoconductive member and the transfer member of FIG. 6D.

The transfer members 130 of FIGS. 6A-6C provide an outer surface that is planar or substantially planar and a cross-section that is substantially rectangular. FIG. 6D illustrates another example embodiment in which the outer surface of transfer member 130 is non-planar and transfer member 130 does not have a rectangular cross-section. Specifically, transfer member 130 of FIG. 6D is curved so that when it is oriented relative to photoconductive drum 125 (FIG. 11), transfer member 130 bows away from photoconductive drum 125 at the entry and exit portions of transfer nip 205, relative to a center portion of transfer member 130. The curved outer surface of transfer member 130 allows the electric field generated by electrodes 237A and 237B to build more gradually and reduce the possibility of mechanical problems (wear, scratching, etc.). In an example embodiment, substrate 220 is a PCB having electrodes 235, 237 that are traces formed on and conform to the outer surface of the PCB. In another example embodiment, substrate 220 is a flexible PCB. In using the transfer member 130 of FIG. 6D, steps may be taken during the manufacturing process to ensure that the mechanical location of the electrodes 235, 237 relative to the substrate remained tightly controlled so that electrodes 237 control the shape of the generated electric field as desired.

Figure 6E:
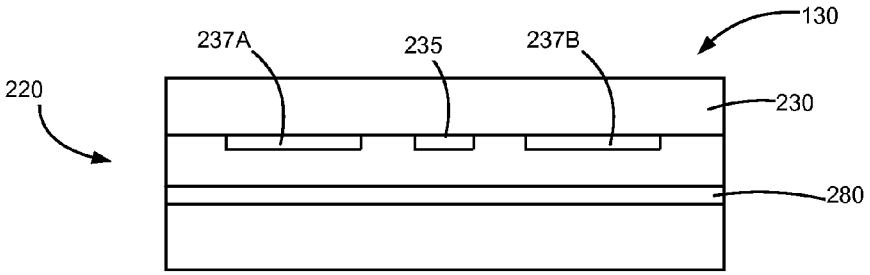

Substrate 220 is described in some example embodiments above as a PCB. Specifically, the PCB may be a multilayer PCB. As shown in FIG. 6E, the multilayer PCB forming substrate 220 may include a ground plane 280 disposed beneath and electrically isolated from electrodes 235, 237. Ground plane 280, formed from a metal plane within the PCB, serves to shape the electric field generated by electrodes 235, 237 as well as shield other components in image forming device 100 from the electric field. In another embodiment, the metal layer plane is coupled to another reference voltage instead of a ground reference. It is understood that the multilayer PCB of FIG. 13 may include layers in addition to ground plane 280.

Figure 7A:
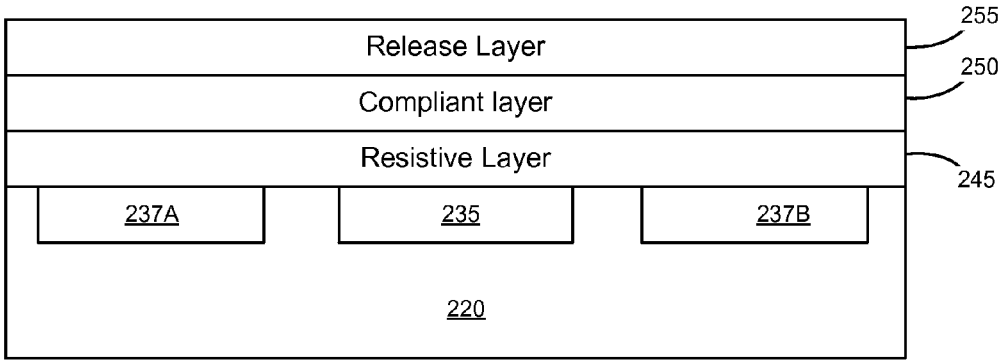
FIGS. 7A and 7B are cross-sectional views of the transfer member according to additional example embodiments.

Coating 230 may functionally establish voltage distribution on the underside of ITM 115. In an example embodiment, coating 230 may comprise one or more materials that provide electrical properties to allow: voltage distribution; compliance such that its surface is conformant to ITM 115 so that there may be no unintended air gaps in the functional regions; low friction with respect to ITM 115; and good wear properties against the abrasive condition at the transfer station 127. In one example embodiment, coating 230 may be provided as a homogeneous layer including a compliant resistant layer with the aforementioned characteristics. For example, coating 230 may include a semi-conductive foam material doped with carbon black or an ionic salt that provides good wear characteristics. In another example embodiment, coating 230 may be provided as a layer system with a plurality of layer parts. For example, as shown in FIG. 7A, coating 230 may include a resistive layer 245, a compliant layer 250 formed over the resistive layer 245, and a release layer 255 formed over the compliant layer 250. Resistive layer 245 may provide the electrical properties for coating 230 and may be selected depending upon resistivities of the photoconductive drum 125 and ITM 115. For example, resistive layer 245 may be about an order of magnitude lower in resistivity relative to ITM 115, such as about $4\times10^8$ Ω~cm, so that voltage provided from center electrode 235 may be effectively projected towards ITM 115 for voltage distribution. Compliant layer 250 may have properties that enhance electrical properties of coating 230 while providing conformance to ITM 115, and release layer 255 may form the outermost layer of the coating 230 and may have low surface energy to provide low friction and controlled surface properties for efficient release of the ITM 115 as it moves during a transfer process.

Figure 7B:
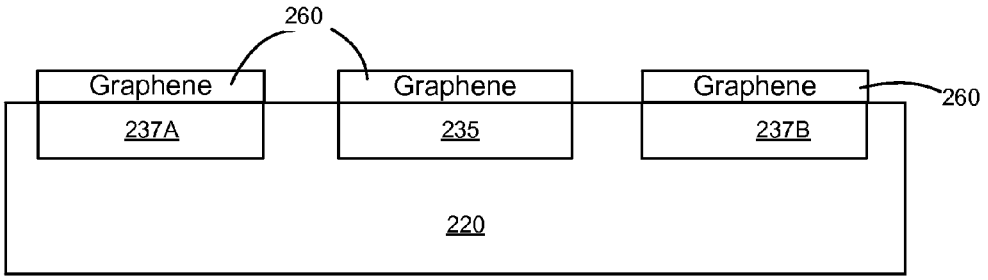

In another example embodiment, as shown in FIG. 7B, coating 230 is a graphene layer 260. Graphene layer 260 is formed only over each electrode 235 and 237. Graphene layer 260 serves as the protective coating for electrodes 235, 237. The crystal structure of the metal (copper) electrode 235, 237 acts as a seed for the formation of graphene crystals thereon. Further, since a protective dielectric coating typically diffuses the electric field generated by electrodes 235 and 237, graphene layer 260 allows better control of the strength and shape of the electric field generated by electrodes 235, 237. Graphene layer 260 is depicted for illustrative purposes as having a thickness that is roughly half of the thickness of electrodes 235 and 237. It is understood that the thickness of graphene layer 260 may be much less than the thickness of electrodes 235 and 237, such as by at least an order of magnitude.

Referring back to FIGS. 6A-6C, each of the electrodes 235, 237 may be coupled to a voltage source 240. Though not shown, electrodes 235, 237 of transfer member 130 of FIG. 6D are connected to voltage source 240 in the same way as such electrodes are connected to voltage source 240 in FIGS. 6A-6C. In an example embodiment, controller 165 may be electrically connected to voltage source 240 and together therewith provide a control mechanism for controlling voltage levels applied to each of the electrodes 235, 237 to produce and control an electric field for causing toner transfer at the transfer station 127. Voltage source 240 may include voltage supply circuitry coupled between transfer member 130 and an external voltage supply line, for example, for generating the relatively higher voltage levels to facilitate a toner transfer operation.

Figure 8:
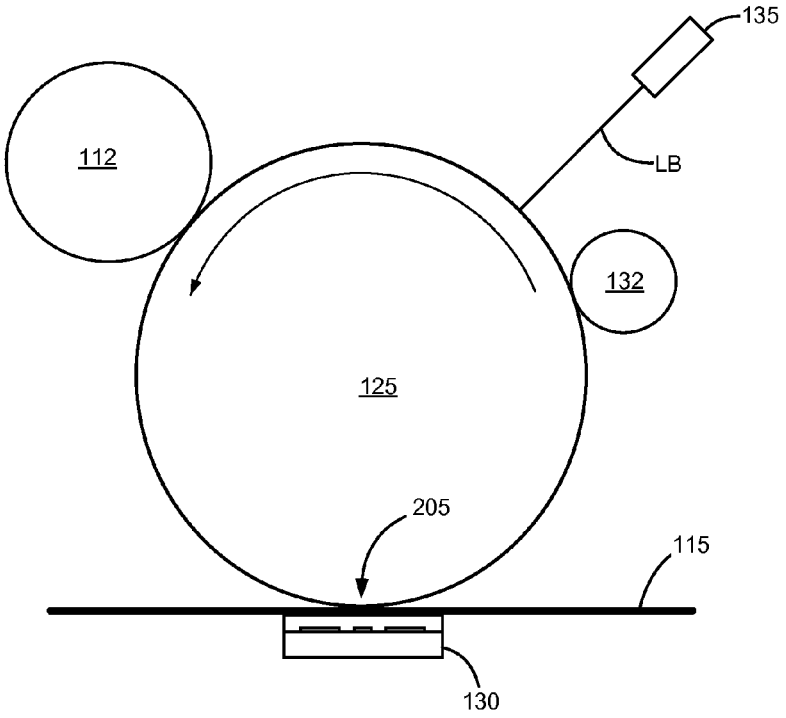
FIG. 8 is a diagram illustrating a transfer region formed between a photoconductive member and the transfer member of FIG. 5 according to an example embodiment.
Figure 9:
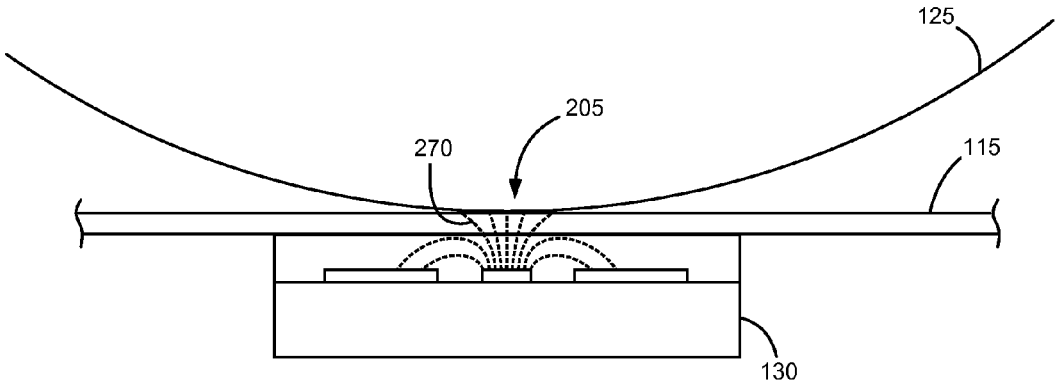
FIG. 9 is a diagram illustrating an electric field generated between the photoconductive member and transfer member in FIG. 8.

With reference to FIGS. 8 and 9, a transfer process utilizing the above electrode-based transfer configuration will now be described by way of an example. In FIG. 8, photoconductive drum 125 and transfer member 130 are arranged to form nip region 205 with ITM 115. In the example shown, electrodes 235, 237 are positioned sequentially along the process direction (left to right), with center electrode 235 positioned about the center nip position of nip region 205 and guard electrodes 237A, 237B positioned upstream and downstream of center electrode 235, respectively, relative to the process direction. Further, the outer surface of coating 230 abuts against the underside of ITM 115 such that substantially no air gap exists. It will be appreciated, though, that other positions or arrangements of the transfer member 130 may be applied, such as offset from the center nip position of the nip region 205.

In operation, charge roller 132 may charge the surface of the photoconductive drum 125 to a specified voltage, such as approximately −800 V. Laser beam LB from LSU 135 illuminates the surface of photoconductive drum 125 to discharge areas thereon to approximately −300 V, for example, to form a latent image on the surface of the photoconductive drum 125. The developer roll 112 may be charged to a voltage bias level between the voltage of the non-discharged areas of the photoconductive drum 125 surface and the discharged latent image, such as approximately −600 V, to thereby charge toner on the developer roll 112. As the photoconductive drum 125 rotates, negatively-charged toner on developer roll 112 is attracted and transfers to the most positive surface area, i.e., the area discharged by the laser beam LB, of the photoconductive drum 125 to develop the latent image thereon. As the photoconductive drum 125 further rotates, a positive electric field may be produced by the transfer member 130 to attract and transfer the toner on the photoconductive drum 125 to ITM 115 at the nip region 205.

In an example embodiment, center electrode 235 may be biased at a voltage level to generate the positive electric field at the nip 205 sufficient enough to overcome forces of adhesion holding the negatively-charged toner on the photoconductive drum 125 and attract the toner to ITM 115, and to hold in place toner deposited on ITM 115 post-nip. On the other hand, guard electrodes 237 may be biased to control the shape and/or position of the electric field at or immediately around the nip region 205.

More particularly, in FIG. 9, the positive electric field is schematically illustrated by field lines 270 generated by the center electrode 235. (It should be noted that this illustration is provided to facilitate understanding of the invention and that the field lines illustrated may not necessarily follow exact and/or actual field lines of the electric field). The positive electric field may be generated by applying a voltage bias to center electrode 235 that is offset from the photoconductive drum 125 surface by some amount, such as a voltage bias that is substantially more positive (e.g., 300 V) than voltage levels at the photoconductive drum 125 surface. The positive polarity charge on the center electrode 235 may be adjusted to adjust the magnitude of the positive electric field.

The positive electric field may further be shaped by bias voltages applied to each of the guard electrodes 237. For example, the guard electrodes 237 may be applied with bias voltages that are offset from the bias voltage applied to center electrode 235, such as bias voltages that are substantially less positive than the applied bias for the center electrode 235, and/or substantially matched to the photoconductive drum 125 surface (e.g., −300 V) or closer in potential thereto than the bias of center electrode 235. Electric fields induced in the guard electrodes 237 may tend to influence the positive electric field at the nip region 205. As shown in FIG. 9, for example, electric field lines exist between the center electrode 235 and the photoconductive drum 125, and may bend upon crossing the coating 230 and ITM 115 and ultimately terminate at the negatively charged surface of the photoconductive drum 125. When a less positive bias relative to that applied to center electrode 235 (e.g., −300 V) is applied to each of the guard electrodes 237, field lines emanating from the edges of center electrode 235 (e.g., field lines 270A and 270B) may bend toward and end on the guard electrodes 237 rather than the photoconductor drum 125 because of close proximity of the guard electrodes 237 to center electrode 235. In an example embodiment, coating 230 may have a thickness that is less than or equal to a spacing between electrodes 235, 237 in order to provide a distance between the center electrode 235 and photoconductive drum 115 sufficient to establish needed electric field at the nip region 205. Accordingly, the shape and placement of the electric field at the nip region 205 may be controlled by varying applied voltages on each guard electrode 237. As will be appreciated, the guard electrodes 237 may be biased differently and/or independently from one another.

In another example embodiment, voltage source 240 is a low voltage power supply and the voltages applied to guard electrodes 237 and center electrode 235 are voltages within a voltage range that is limited by the low voltage power supply. For example, the voltages applied to guard electrodes 237 and center electrode 235 may be between 1v and about 500v, and particularly between about 1v and about 50v.

In an example embodiment, the shape and placement of the electric field at the nip region 205 may be controlled to limit high strength electric field values at non-functional areas outside the nip region 205. Accordingly, high strength electric field values may be controlled to exist only within functional areas of the nip region 205 where toner transfer occurs. Depending on a number of factors and design parameters such as, for example, electrode sizes, electrode spacing, material composition and thickness of the coating, process speed, environmental conditions, the electric field magnitude, shape and/or placement thereof can be tightly controlled by controlling the bias or voltage level of each electrode such that dielectric breakdown can be reduced or avoided and efficient transfer can be achieved.

Figure 1B:
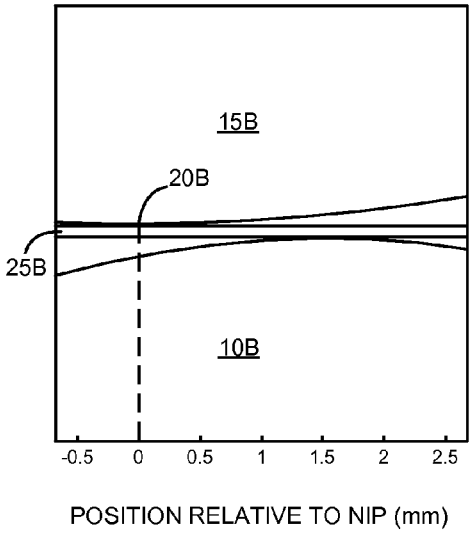
FIG. 1B (PRIOR ART)
FIG. 1B is a diagram illustrating an example model of another traditional roller-based transfer configuration having an offset arrangement between a transfer roller and a photoconductive drum.
Figure 2:
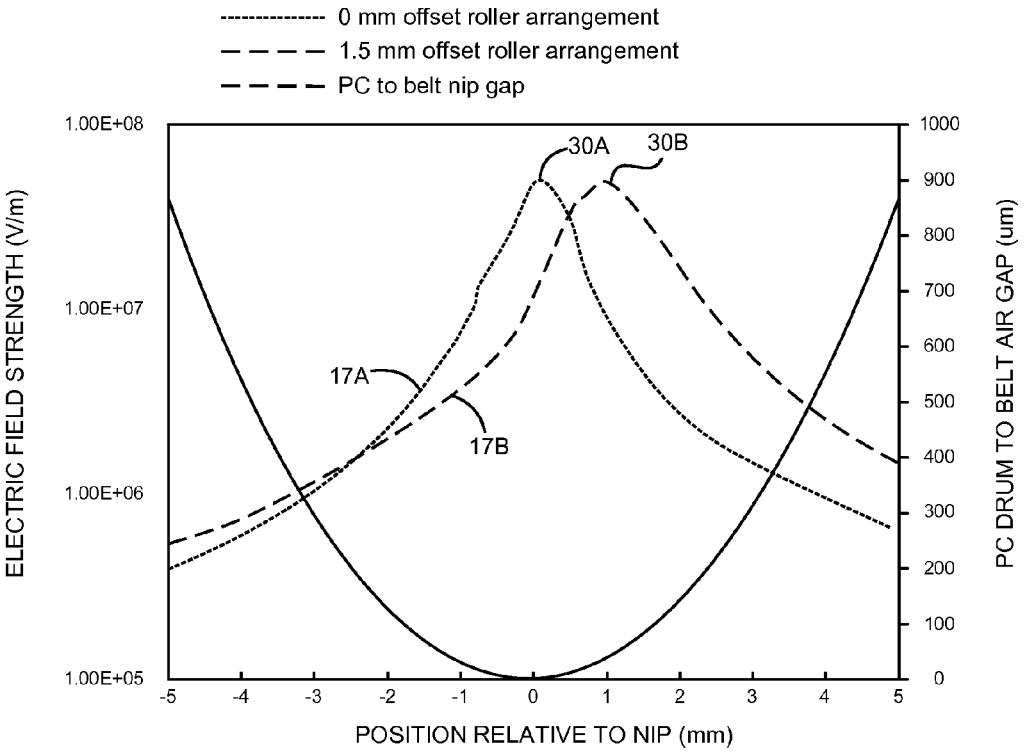
FIG. 2 (PRIOR ART)
FIG. 2 is a diagram illustrating graphs of electric field magnitudes for the roller-based transfer configurations of FIGS. 1A and 1B.
Figure 10:
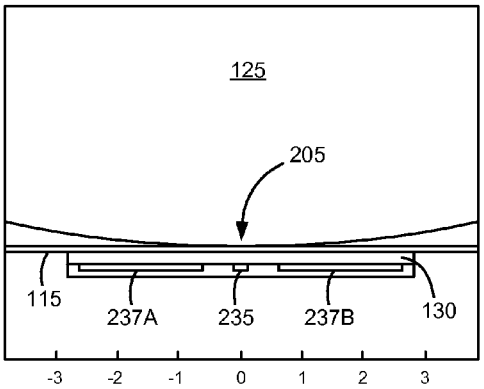
FIG. 10 is a schematic diagram of the electrode-based transfer configuration in FIG. 9.
Figure 12:
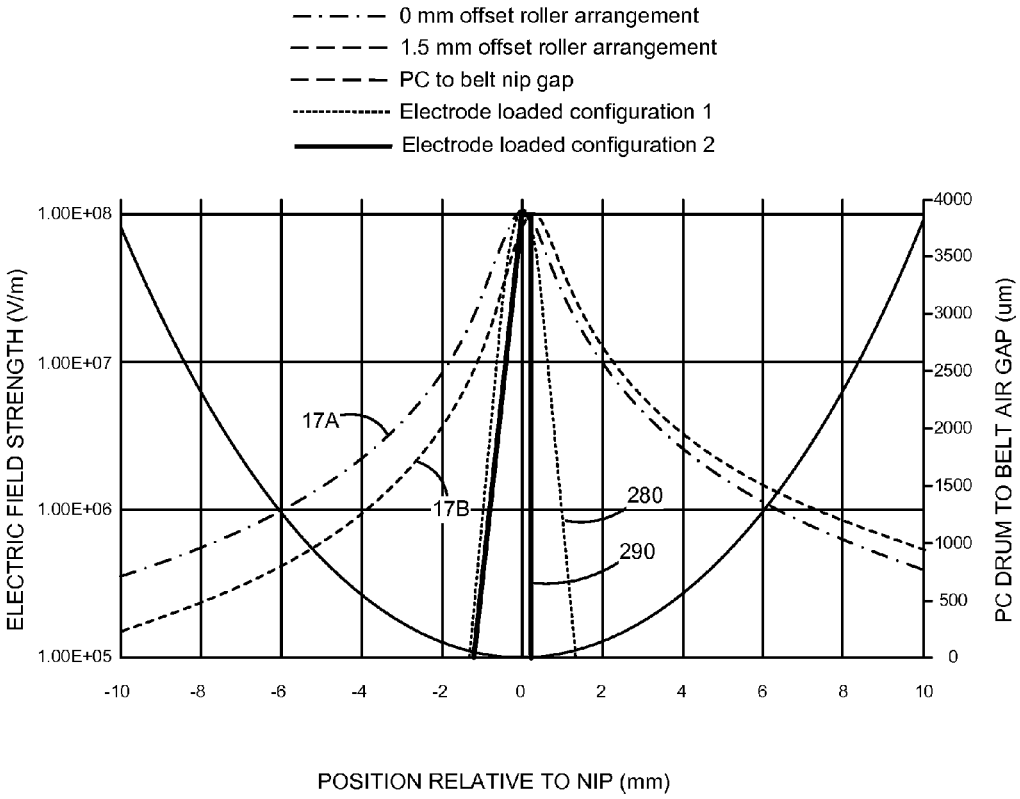
FIG. 12 is a diagram illustrating a graph of electric field magnitudes for the model shown in FIGS. 10 and 11 superimposed on graphs of electric field magnitudes for the traditional roller-based transfer configurations shown in FIG. 2.

FIG. 10 illustrates an example schematic diagram of the electrode-based transfer configuration (illustrated based on a finite element model) including transfer member 130 arranged to form nip region 205 (nip center position at 0 mm) with photoconductive drum 125 and ITM 115, and FIG. 12 is a diagram illustrating a graph 280 of electric field magnitudes in the air gap at the nip region 205 for the electrode-based transfer configuration (according to a first example embodiment) superimposed on the graphs 17 (FIG. 2) of the roller-based transfer configurations of FIGS. 1A and 1B. It is further noted that these illustrations are representative models provided to facilitate understanding of the invention and thus should not be considered limiting.

In the example embodiment, the electrode-based configurations described above allow for substantially limiting or otherwise eliminating high strength field values in areas outside of the nip region 205. That is, graph 280 shows that electric field values approximately 1 mm outside the nip region 205 are limited below $1\times10^5$ V/m while relatively high strength electric field values greater than $1\times10^7$ V/m are maintained within a closer range around the nip center position at 0 mm, in contrast to graphs 17A and 17B of the traditional roller-based transfer configurations which tend to disadvantageously sustain relatively high electric field values at distances far removed from the nip region 205.

Thus, in the above example embodiments, by applying bias voltages to guard electrodes 237 as described above, the voltage level applied to the center electrode 235 may be adjusted to control the magnitude of the electric field generated at and immediately around the nip region 205. On the other hand, guard electrodes 237 may be biased at voltage levels different from the voltage level applied to the center electrode 235 in order to control the shape and/or position of the electric field at the nip region 205. As a result, the transfer field may be controlled to have high strength fields where functionally required, i.e., where toner on the photoconductor drum 125 is in close proximity to the nip and just upon separation of the nip so that toner can be held down to the ITM 115 as ITM 115 exits the nip, and relatively low strength field values in non-functional regions surrounding the nip and on the underside of the ITM would be, if not substantially eliminated, made negligible.

In particular, the guard electrodes 237 may be biased at voltage levels so as to gradually increase the transfer field as toner on photoconductive member 125 approaches transfer nip 205, hold the field relatively constant while toner is in the nip, and quickly decrease the field as toner on the media sheet exits the nip before the voltage across the air gap causes a breakdown event. In another example embodiment shown in FIG. 12, graph 290 depicts the waveform of an electric field generated using any of the transfer members 130 described above. Graph 290 shows the electric field gradually increases from about $1\times10^5$ V/m at a distance of approximately 1.2 mm from the nip center, reaching a maximum of about $1\times10^8$ V/m at the nip center, and quickly decreases to below $1\times10^5$ V/m at a distance of approximately 0.3 mm from the nip center, while the air gap is still approximately zero. As shown, the magnitude of the slope of graph 290 on the exit side of transfer nip 205 (i.e., positions on the X-axis to the right of 0) is between about 3 and about 7 times the magnitude of the slop of the graph on the entry side of transfer nip Graph 290 (positions on the X-axis to the left of 0), and particularly between about 4 and about 6 times thereof. In addition, graph 290 may depict an electric field generated using voltages created from a low voltage power supply. For example, for transfer member 130 of FIG. 6A, the voltage level applied to guard electrode 237A may be about 25V, the voltage level applied to central electrode 235 may be about 50V, and the voltage level applied to electrode 237B may be about 0V. It would be appreciated that these values would be dependent upon the final hardware configuration and factors such as material properties, geometry, material thickness, and air gaps. Further, transfer member 130 of FIGS. 6B-6D could be used to more precisely control the field shape. Transfer member 130 of FIG. 6C, for example, would add a greater number of discrete field anchor points for the generated magnetic field. Additionally, displacement current effects are also substantially reduced or mitigated.

Although the above example embodiments show three and four electrodes for the transfer member 130, it will be understood that utilizing three electrodes is not a requirement and that having two electrodes or greater than three and four electrodes are equally applicable. Additional guard electrodes may also provide the opportunity to more precisely shape and locate the electric field and eliminate the possibility of breakdown in unintended areas near the transfer nip. In addition, the shape of the coating for the transfer member may follow other shapes, such as substantially curved, and may not necessarily be planar as illustrated in the drawings. Further, the electrode-based transfer design may be implemented while eliminating or reducing sources of other variation like support for a broad dynamic range of process speeds, moisture absorption across different classes of environments, or force and position variance due to mechanical tolerances.

Applications of the various embodiments of the present disclosure may also go beyond use at the first transfer area 105 and can be applied at the second transfer area 135. For example, second transfer area 135 may be configured to adapt an electrode-based transfer configuration as discussed above with respect to the first transfer area 105, with second transfer member 145 having similar structure as transfer member 130, ITM 115 acting as the toner donating member, and a media sheet as a toner receiving medium. Additionally, the electrode-based transfer configuration described above may also be applied in a monochrome electrophotographic imaging device in which a single photoconductive member deposits black toner directly to media sheets. For example, a transfer member which directly forms a nip with the photoconductive member and used to generate needed electric field to transfer toner from the photoconductive member directly to a media sheet passing through the nip may have a similar structure as transfer member 130. In these example embodiments, electrical properties of the media sheet such as dielectric breakdown strength, resistance, and moisture content, among others, may additionally be considered in making adjustments to applied bias voltages on each electrode so as to achieve efficient transfer while avoiding dielectric breakdown of the media sheet and/or at air gaps.

The foregoing description of several example embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A device for transferring images from an image donating member to an image receiving medium, comprising:

a substrate;

at least three electrodes disposed on the substrate, including a center electrode and at least two guard electrodes disposed at opposed sides of the center electrode; and at least one coating layer disposed on the at least three electrodes and having an outer surface for forming a nip region with the image donating member;

wherein the at least two guard electrodes comprise a first guard electrode and a second guard electrode, and wherein a distance between the first guard electrode and the center electrode is greater than a distance between the center electrode and the second guard electrode, wherein the substrate, the at least three electrodes and the at least one coating layer form a transfer member of the device, the transfer member forming the nip region with the image donating member, and the device further comprises voltage supply circuitry for supplying bias voltages to the at least three electrodes so as to produce an electric field and control a position thereof at the nip region in order to allow the electric field to act upon and cause toner to transfer from the image donating member to the image receiving medium, and wherein a slope of the electric field on an output side of the nip region has a magnitude that is at least two times greater than a magnitude of a slope of the electric field on an input side of the nip region.

2. The device of claim 1, wherein the substrate, the at least three electrodes and the at least one coating layer combined have a substantially non-rectangular cross-section.

3. The device of claim 1, wherein a surface on which the at least three electrodes are disposed is curved.

4. The device of claim 1, wherein the at least two guard electrodes further comprises a third guard electrode, the third guard electrode is disposed on the substrate between the first guard electrode and the center electrode.

5. The device of claim 1, wherein the center electrode has a width that is different from corresponding widths of the at least two guard electrodes.

6. The device of claim 1, wherein the at least one coating layer comprises a graphene layer disposed directly on top of the at least three electrodes.

7. The device of claim 1, wherein the substrate comprises a printed circuit board and the at least three electrodes form traces of the printed circuit board.

8. The device of claim 7, wherein the printed circuit board comprises a flexible printed circuit board.

9. The device of claim 7, wherein the printed circuit board comprises a multilayer printed circuit board and includes a plane of metal disposed within the printed circuit board.

10. The device of claim 1, further comprising a controller electrically connected to the voltage supply circuitry, the controller controlling the voltage supply circuitry and the bias voltages supplied to the at least three electrodes.

11. The device of claim 1, wherein the at least three electrodes consist of the center electrode, the first guard electrode and the second guard electrode, the center electrode, first guard electrode and second guard electrode being the only electrodes on the substrate facing the image donating member, and the second guard electrode is spaced further away from the center electrode than the first guard electrode is spaced from the center electrode.

12. A toner transfer system, comprising:

a donating member for donating toner;

a transfer member including a substrate, at least three electrodes disposed on the substrate, and a coating formed on the at least three electrodes, the transfer member serving to form a nip region with the donating member, the transfer member, including the at least three electrodes, being stationary relative to the nip region; and voltage supply circuitry coupled to the transfer member for supplying bias voltages to the at least three electrodes so as to produce an electric field and control a position thereof at the nip region to allow the electric field to act upon and cause toner to transfer from the donating member to a toner receiving medium disposed between the donating member and the transfer member in the nip region during a toner transfer operation, the transfer member being separate from the toner receiving medium;

wherein the at least three electrodes comprise a center electrode and at least two guard electrodes disposed at opposed sides of the center electrode, the center electrode for generating and controlling a magnitude of the electric field, and the guard electrodes for controlling the shape of the electric field at the nip region, and wherein a slope of the electric field on an output side of the nip region has a magnitude that is at least two times greater than a magnitude of a slope of the electric field on an input side of the nip region.

13. The system of claim 12, wherein the at least two guard electrodes comprise a first guard electrode and a second guard electrode, and wherein a distance between the first guard electrode and the center electrode is greater than a distance between the center electrode and the second guard electrode, the first guard electrode is disposed at the input side of the nip region and the second guard electrode is disposed at the output side of the nip region.

14. The system of claim 13, the at least two guard electrodes further comprises a third guard electrode, the third guard electrode is disposed on the substrate between the first guard electrode and the center electrode, the first and third guard electrodes being disposed on the input side of the nip region.

15. The system of claim 12, wherein the center electrode receives a bias voltage from the voltage supply circuitry that is different from a bias voltage received by each of the at least two guard electrodes, the bias voltages received from the voltage supply circuitry being between about 1v and about 100v.

16. The device of claim 12, wherein the substrate has a substantially non-rectangular cross-section.

17. The device of claim 16, wherein the substantially non-rectangular cross-section comprises a curved shape such that a first end at the input side of the nip region and a second end at the output side of the nip region are bowed away from the donating member, relative to a center portion of the transfer member.

18. The system of claim 12, wherein the coating comprises a graphene layer disposed directly on the at least three electrodes.

19. The system of claim 12, wherein the substrate comprises a printed circuit board having a metal layer plane disposed therein.

20. The system of claim 12, wherein the magnitude of the slope of the electric field on the output side of the nip region is between about 3 and about 7 times greater than the magnitude of the slope of the electric field on the input side of the nip region.

21. The system of claim 12, wherein the voltage supply circuitry comprises a low voltage power supply.

* * * * *